US006428647B1

(12) United States Patent
Koh et al.

(10) Patent No.: US 6,428,647 B1
(45) Date of Patent: Aug. 6, 2002

(54) ORGANIC SOLVENT COMPOSITION FOR FILM TRANSFER AND A METHOD FOR WET TRANSFERRING OF TRANSFER FILM

(75) Inventors: Hyun-Joo Koh, Shiheung; Hyun-Woong Koh, Inchon, both of (KR)

(73) Assignee: Yemoon Tech Co., Ltd., Seoul (KR)

( * ) Notice: Subject to any disclaimer, the term of this patent is extended or adjusted under 35 U.S.C. 154(b) by 54 days.

(21) Appl. No.: 09/668,470

(22) Filed: Sep. 25, 2000

(30) Foreign Application Priority Data

Sep. 28, 1999 (KR) ..... 99-41615

(51) Int. Cl.[7] ..... B44C 1/175; B41M 2/12; B41M 5/04; B05D 5/04; B05C 3/02

(52) U.S. Cl. ..... 156/230; 156/236; 156/240; 156/247; 156/277; 427/149; 427/336; 427/430.1; 428/914; 118/403; 101/34; 568/303; 568/678; 560/71

(58) Field of Search ..... 156/230, 236, 156/237, 240, 241, 247, 277, 289; 427/146, 147, 149, 299, 336, 280, 430.1, 335, 337; 428/195, 914; 118/402, 403, 404; 101/33, 34; 568/303, 678; 560/71

(56) References Cited

U.S. PATENT DOCUMENTS 4,269,650 A * 5/1981 Arai et al. ..... 156/540
6,015,848 A * 1/2000 Ikushima et al. ..... 523/427

FOREIGN PATENT DOCUMENTS

EP 0 858 912 8/1998
JP 52041682 3/1977
JP 57050547 3/1982
JP 04-308798 * 10/1992 ..... B44C/1/175
JP 7047798 2/1995
JP 9-58196 3/1997
KR 91-2529 4/1991
KR 96-2721 11/1994
KR 269772 6/1998
WO 97/29239 8/1997

* cited by examiner

*Primary Examiner*—J. A. Lorengo
(74) *Attorney, Agent, or Firm*—Jacobson Holman, PLLC

(57) ABSTRACT

The present invention provides an organic solvent composition for wet transferring of a transfer film having improved weather-resistance suitable for external ornaments and a method for wet transferring therewith, which comprises a step of transferring patterns directly to the concave-convex surfaces of objects made of various materials such as steel, aluminum, plastic, ceramic, rubber or glass. The wet transferring method using organic solvent composition of the present invention comprises the steps of: coating the surface of an object with the organic solvent composition; transferring a pattern from a pattern-printed transfer film onto the surface of the object by means of liquid pressure driven by floating the transfer film on water in a water tank and pressing the object whose surface is coated with the organic solvent composition onto the film; and, washing the pattern-printed object with water, and then drying the object in oven. In accordance with the improved wet transferring method of the invention, wet transfer can be accomplished in a simple and economical manner by minimizing the consumption of the organic solvent and requiring no high-cost facilities for environmental protection. Also, an additional advantage such as production of pattern-transferred concave-convex surface with superior physical properties may be realized by controlling the content of the organic solvent composition.

3 Claims, 1 Drawing Sheet

ORGANIC SOLVENT COMPOSITION FOR FILM TRANSFER AND A METHOD FOR WET TRANSFERRING OF TRANSFER FILM

FIELD OF THE INVENTION

The present invention relates to an organic solvent composition for film transfer and a method for wet transferring therewith, more specifically, to an organic solvent composition for wet transferring of a transfer film having improved weather-resistance suitable for external ornaments and a method for wet transferring therewith, which comprises a step of transferring patterns directly to the concave-convex surfaces of objects made of various materials such as steel, aluminum, plastic, ceramic, rubber or glass.

BACKGROUND OF THE INVENTION

It has been well known that transfer films are manufactured to give multi-layered forms which comprise: release layer, protective layer, print layer and adhesive layer in order(see: Japanese Patent laid-open Publication No. (Hei) 9-58196); lubricating layer, print layer, masking layer and adhesive layer in order(see: Japanese Patent laid-open Publication No. (Hei) 7-47798); or, resin layer, lubricating layer, protective primer layer and print layer in order(see: Korean Patent Publication No. 96-2721). Since the prior art transfer films generally comprises basic layer, lubricating layer, print layer and adhesive layer, they have revealed inherent disadvantages that the releasing process is very laborious during wet transfer and the transferring process of desired patterns to the concave-convex surface during thermal transfer is very difficult. In addition, the conventional transfer films have inferior physical properties, such as low paint coat adhesion, poor weather-, alkali- and scratch- resistance (low pencil hardness), and uneven thickness of the painted coat.

Korean Patent No. 269772 discloses a transfer film comprising basic layer, print layer and pliable coat layer, which is designed to solve the said problems. However, they do not consider the weather-resistance of transfer film seriously, even though the film for an external ornament is destined to be exposed to harsh weather conditions like sunlight (ultraviolet), rain and wind for a long period time, which naturally limits its practical application.

On the other hand, numerous methods for transferring films having a variety of patterns to various kinds of concave-convex surfaces have been known in the art:

For example, Korean Patent Publication No. 91-2529 teaches a method of forming a glossy pattern on an object by printing a patterned mold on the surface of the object using a paste material by screen printing, heating it over 400° C., dipping the molded object into a solution of metal oxide which is reactive with the uncovered area of the surface of the object, and then removing the mold from the object. Also, several related methods are known in the art, such as described in Japanese Patent Publication No.(Sho)52-41682 and (Sho)57-50547. However, these transfer methods are rather limited in their practical application due to the following disadvantages: transferring processes are laborious; the materials for the objects are limited; the color is easily faded or deteriorated; the patterns should be formed on the object prior to transferring; and, high cost is required to carry out the methods.

In an effort to overcome many limitations of the prior art described above, wet transfer and thermal transfer methods have been proposed in the art.

Thermal transfer method, in general, comprises the steps of pressing the film onto an object using a heated press and then peeling off the resinous support layer, in which films prepared by coating the resinous support layer with the mixture of lubricating resin and organic solvents such as celluloseacetate, methylethylketone (MEK), ethanol or toluene, coating with nitrocellulose and the like thereon to prevent fissure between the said resin layer and print layer while improving adhesive property, and then thereon printing the mixture of urethane resin, dye, and organic solvent such as toluene or methylethylketone. This method is, however, proven to be less satisfactory in the senses that: pressing and removing resinous support layer are laborious, transferring of the films to the concave-convex surface is complicate, and mass production of patterned objects is relatively difficult.

On the other hand, wet transfer method, when applied to the concave-convex surface, is generally accomplished by floating a pattern-transferred film on water, in which the transfer film is prepared by transferring paint or transfer ink to a sheet, transferring the transfer film to the concave-convex surface of an object by means of liquid pressure attained by pressing the object onto the above film, and then dipping the pattern-transferred concave-convex surface into water at 20 to 35° C. for 5 to 10 minutes to get rid of paint components in the transfer film, followed by washing with clean water at room temperature and drying in an oven maintained at 100 to 250° C., and then repeated coating to get better quality of surfaces.

The wet transfer method essentially employs a step of coating the film with organic solvent before transferring to the object, where direct spraying of organic solvent onto the film floated on water tank is generally carried out. However, the step of applying the film with organic solvent by spraying of volatile organic solvent has revealed disadvantages of the large consumption of organic solvent, as well as the requirement of facilities for environmental protection to prevent the exhaust of organic solvent.

Under the circumstances, there are strong reasons for exploring and developing an alternative method for wet transferring to solve the said problems in the art.

SUMMARY OF THE INVENTION

The present inventors have made an effort to develop an improved method for wet transferring of a transfer film with many desirable physical properties where a pulp layer consisting of water, polyvinylalcohol, starch and pulp as main components, and sugar, soap, glue, latex, silicon oil and water-soluble antistatic agent as minor components is laminated with a main film layer consisting of all components of the pulp layer except pulp, on which a print layer is laminated with an ink containing ceramic pigment and fluorinated resin for transfer of various patterns to all kinds of concave-convex surfaces and external ornaments. For wet transferring of the transfer film, an organic solvent composition comprising methylethylketone, xylene, ethyleneglycol monobutylether and isophorone or methylsalicylate is employed, with which the surface of an object is directly coated without spray-coating, assuring uniform coating over the surface of the object to give many desirable physical properties of the pattern-transferred object in terms of coat adhesion, pencil hardness, quality of coating, endurance, acid-, alkali- and weather-resistance.

A primary object of the present invention is, therefore, to provide an organic solvent composition which can be directly applied to the surface of an object during wet transfer of a transfer film.

The other object of the invention is to provide a method for wet transferring using the organic solvent composition.

BRIEF DESCRIPTION OF THE DRAWINGS

The above and the other objects and features of the present invention will become apparent from the following descriptions given in the conjunction with the accompanying drawing, in which.

DETAILED DESCRIPTION OF THE INVENTION

Figure 1:
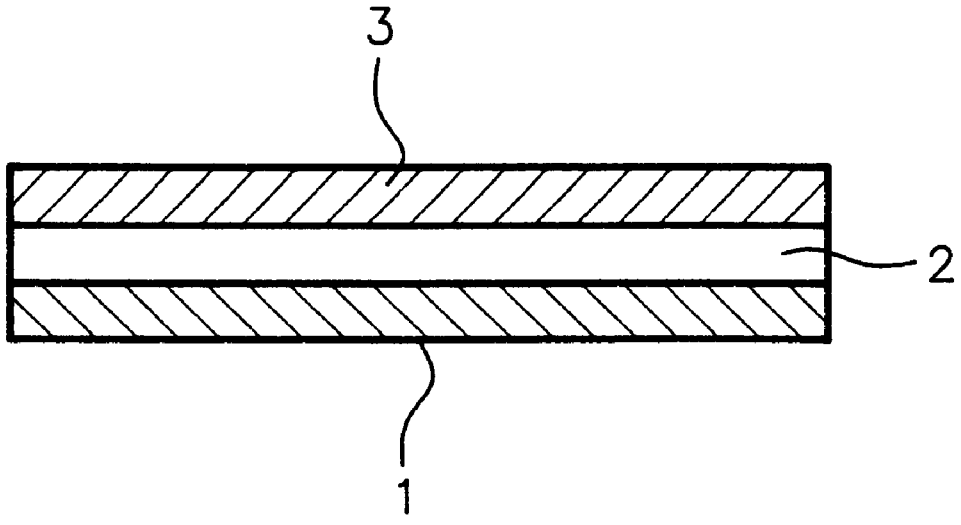
FIG. 1 is a schematic diagram depicting a transfer film which consists of a pulp layer (1), a main film layer (2) and a print layer (3) in order.

The present inventors employed a transfer film for external ornament which consists of a pulp layer (1), a main film layer (2) and a print layer (3) in order (see: FIG. 1).

The pulp layer (1), which plays a role of supporting a printed pattern, is obtained by mixing 40 to 60 wt % water, 20 to 30 wt % polyvinylalcohol (PVA), 10 to 20 wt % pulp, 6 to 10 wt % starch, 2 to 4 wt % sugar, 3 to 7 wt % soap, 1 to 3 wt % glue, 3 to 7 wt % latex, 0.5 to 2 wt % silicon oil and 0.5 to 5 wt % water-soluble antistatic agent, where water, polyvinylalcohol, pulp and starch constitute a base of the pulp layer, and sugar, soap, glue and latex are added to prevent the printed pattern from diffusing during wet transfer, silicon oil is added for lubrication, and water-soluble antistatic agent is added to prevent static electricity and to ease peeling of the pulp.

The main film layer (2), which is laminated on the pulp layer (1), is obtained by mixing 40 to 50 wt % water, 22.5 to 33.5 wt % PVA, 8 to 12 wt % starch, 2 to 4 wt % sugar, 3 to 7 wt % soap, 1 to 3 wt % glue, 3 to 7 wt % latex, 0.5 to 2 wt % silicon oil and 0.5 to 5 wt % water-soluble antistatic agent, dissolving at 80 to 100° C., paltruding in a thickness of 20 to 100 $\mu$m at a speed of 3 to 10 m/min using a roller, followed by hot-air drying and then cooling under cold air.

The print layer (3) is obtained by printing the desired pattern using an ink containing 20 to 30% (v/v) ceramic pigment and 40 to 60% (v/v) fluorinated resin dissolved in thinner by the aid of a conventional printing method of gravure, offset or silk screening.

On the other hand, organic solvent composition for wet transfer of the present invention comprises methylethylketone, xylene, ethyleneglycolmonobutylether, and isophorone or methylsalicylate.

In the organic solvent composition, 10 to 60 wt % methlethylketone, preferably, 20 to 60% is employed, where up to 50 wt % may be replaced by cyclohexanone. Less than 10 wt % methylethylketone may cause low solubility of dye or pigment which results in insufficient transferring while more than 60 wt % may form bubbles between the transfer film and the surface of an object due to the excessive volatilization of the organic solvent composition during the transferring process.

For xylene, any one of o-xylene, m-xylene or p-xylene may be used, though o-xylene or p-xylene is preferred, where 10 to 50 wt % xylene, preferably, 25 to 50 wt % is employed in the composition. Less than 10 wt % xylene may form bubbles between the transfer film and the surface of an object due to the excessive volatilization of organic solvent during the transferring process while more than 50 wt % may delay drying and exert detrimental effects on the subsequent processes.

For ethyleneglycolbutylether, 10 to 50 wt %, preferably 15 to 40 wt % is employed in the composition. Less than 10 wt % ethyleneglycolbutylether may form bubbles between the transfer film and the surface of an object due to the excessive volatilization of organic solvent during the transferring process while more than 50 wt % may cause low viscosity of organic solvent which disrupts uniform coating of the surface of the object.

Finally, 5 to 20 wt % isophorone or methylsalicylate, preferably, 7 to 12 wt % is employed in the composition. Less than 5 wt % may cause excessive volatilization of organic solvent while more than 12 wt % may delay drying such that proper coating can not be accomplished or ink debris in the transfer tank may stick to the surface of an object.

The wet transferring method using organic solvent composition of the present invention comprises the steps of: coating the surface of an object with the organic solvent composition; transferring a pattern from a pattern-printed transfer film onto the surface of the object by means of liquid pressure driven by floating the transfer film on water in a water tank and pressing the object whose surface is coated with the organic solvent composition onto the film; and, washing the pattern-printed object with water, and then drying the object in oven.

The wet transfer method using organic solvent composition is further illustrated as follows.

Step 1: Coating with the Organic Solvent Composition

An object is coated with the organic solvent composition prepared as above, which may be accomplished by using a brush or dipping the object into the organic solvent composition for a certain period of time.

Step 2: Film Transfer

A pattern from a pattern-printed film is transferred onto the surface of the object by means of liquid pressure driven by floating the film on water in a water tank and pressing the object whose surface is coated with the organic solvent composition onto the film, where the water temperature is maintained at 30 to 50° C. in the tank. Low water temperature below 30° C. may cause not only low efficiency of operation but also poor deposition of dye or pigment, which ultimately gives rise to insufficient transfer. On the other hand, water temperature above 50° C. may form bubbles between the transfer film and the surface of the object due to volatilization of organic solvent composition, which in turn results in low quality of transfer.

Step 3: Washing and Drying of Pattern-transferred Object

The pattern-transferred object is washed in a tank and dried in an oven, where the pattern-transferred object is washed in a water tank maintained at 40 to 80° C. for 5 to 30 minutes, and then dried in an oven. Water temperature should be controlled by heating coil, since inappropriate water temperature of below 40° C. or above 80° C. may cause insufficient transfer of dye or pigment onto the object.

In accordance with the improved wet transferring method of the invention, wet transfer can be accomplished in a simple and economical manner by minimizing the consumption of the organic solvent and requiring no high-cost facilities for environmental protection. Also, an additional advantage such as production of pattern-transferred concave-convex surface with superior physical properties may be realized by controlling the content of the organic solvent composition.

The present invention is further illustrated in the following examples, which should not be taken to limit the scope of the invention.

EXAMPLE 1

Preparation of Transfer Film for External Ornament

A pulp layer was obtained by mixing 45 wt % water, 22 wt % polyvinylalcohol (PVA), 12 wt % pulp, 6 wt % starch, 3 wt % sugar, 4 wt % soap, 2 wt % glue, 4 wt % latex, 1 wt % silicon oil and 1 wt % Pigeon™ as a water-soluble antistatic agent, dissolving at 80 to 100° C., paltruding the mixture in a thickness of 48 μm at a speed of 4 m/min using a roller, air-drying under a temperature of 70° C., and cooling under cold air. Then, a main film layer to be laminated on the pulp layer was obtained by mixing 50 wt % water, 23 wt % PVA, 10 wt % starch, 3 wt % sugar, 5 wt % soap, 2 wt % glue, 5 wt % latex, 1 wt % silicon oil and 1 wt % Pigeon™ as a water-soluble antistatic agent, dissolving at 100° C., paltruding the mixture in a thickness of 48 μm at a speed of 3 to 10 m/min using a roller, air-drying under a temperature of 70° C., and cooling under cold air. Subsequently, a print layer to be laminated on the main film layer, was prepared by printing a wood pattern using an ink containing 25% (v/v) ceramic pigment, 50% (v/v) fluorinated resin and 25% (v/v) thinner by gravure printing method.

Example 2

Preparation of Organic Solvent Composition and Wet Transfer Therewith

Organic solvent composition was prepared by mixing 30 wt % methylethylketone, 30 wt % p-xylene, 30 wt % ethyleneglycolmonobutylether and 10 wt % isophorone, respectively. And then, the concave-convex surface of aluminum was directly coated with the organic solvent composition by using a brush. Subsequently, the pattern was transferred to the concave-convex surface of aluminum by means of liquid pressure generated by floating the transfer film for external ornament prepared in Example 1 on water in a transfer tank maintained at 400° C., and then pressing the object whose surface was coated with the organic solvent composition onto the film. Finally, the pattern-transferred concave-convex surface of aluminum was dipped in a water tank filled with clean water maintained at 600° C. for 10 minutes, washed, and then dried in an oven at 100° C. to complete the transferring. Then, the pattern-transferred concave-convex surface with 1300m$^2$ in area was examined in test items of the consumption of organic solvent composition, the daily production of the pattern-transferred object, gloss and pencil hardness after transferring of the film (see: Table 1).

COMPARATIVE EXAMPLE 1

Wet Transfer Employing the Conventional Organic Solvent Spray-coating Method Pattern transfer to concave-convex surface of aluminum was carried out in an analogous manner as in Example 2, except for employing spray-coating the pattern-printed film with an organic solvent of methylethylketone. And then, the pattern-transferred concave-convex surface with 1300m$^2$ in area was examined in test items of the consumption of methylethylketone, the daily production of the pattern-transferred object, gloss and pencil hardness after the transferring of the film (see: Table 1).

As shown in Table 1 below, the gloss of the pattern printed on concave-convex surface of aluminum employing the organic solvent of the invention, was similar to that of the pattern printed by the conventional method of spray-coating organic solvent on the film. However, it was clearly demonstrated that the consumption of organic solvent could be reduced to the level of 1/5, and the daily production was 3 times higher than that of the conventional method.

TABLE 1

| | Example 1* | Prior art** |
|---|---|---|
| Pencil hardness | 3H | 2H |
| Gloss (60°) % | 30 | 29 |
| Amount of the organic solvent, L/130 m$^2$ | 8 | 40 |
| Daily production | 1800 | 600 |

*Aluminum coated directly with the organic solvent composition
**Film sprayed with methylethylketone Physical Properties of Pattern-transferred Film After transferring the wood pattern of the transfer film for external ornament prepared in Example 1 to a concave-convex surface of aluminum by wet-transfer method of Example 2, the transferred film on the surface was examined in test items of coat adhesion, pencil hardness, quality of coating, acid-resistance, alkali-resistance and weather-resistance, whose results are shown in Table 2.

TABLE 2

Physical properties of a pattern-transferred film

| Test Items | Specified Requirement | Example 1 |
|---|---|---|
| Coat adhesion | 100 | satisfied |
| Pencil hardness | 2H | 3H |
| Quality of coating | appropriate | appropriate |
| Acid-resistance | Treatment with 20% sulfuric acid or 20% HCl for 18 hrs | intact |
| Alkali-resistance | Treatment with 25% NaOH for 1 hr | intact |
| Weather-resistance | 5000 hrs | >5000 hrs |

As shown in Table 2 above, the transferred film on external ornament satisfied all of the requirements of coat adhesion, pencil hardness, quality of coating, acid-, alkali- and weather-resistance. Particularly, it was clearly demonstrated that the transferred film on external ornament can be preserved for more than 20 years due to the improved weather-resistance, since the time span of 5,000 hours is equivalent to the actual life span of 20 years.

As clearly illustrated and demonstrated as above, the present invention provides an organic solvent composition for wet transferring of a transfer film having improved weather-resistance suitable for external ornaments and a method for wet transferring therewith, which comprises a step of transferring patterns directly to the concave-convex surfaces of objects made of various materials such as steel, aluminum, plastic, ceramic, rubber or glass. In accordance with the improved wet transferring method of the invention, wet transfer can be accomplished in a simple and economical manner by minimizing the consumption of the organic solvent and requiring no high-cost facilities for environmental protection. Also, an additional advantage such as production of pattern-transferred concave-convex surface with superior physical properties may be realized by controlling the content of the organic solvent composition.

What is claimed is:

1. An organic solvent composition for film transfer which comprises 10 to 60 wt % methylethylketone, 10 to 50 wt % xylene, 10 to 50 wt % ethyleneglycolmonobutylether, and 5 to 20 wt % isophorone or methylsalicylate.

2. A method for wet transferring of transfer film which comprises the steps of:

coating the surface of an object with the organic solvent composition of claim 1;

transferring a pattern from a pattern-printed transfer film onto the surface of the object by means of liquid pressure driven by floating the film on water maintained at 30 to 50° C. in a water tank and pressing the object whose surface is coated with the organic solvent composition onto the film; and, washing the pattern-printed object with water at 40 to 80° C. and drying the object in oven.

3. The method for wet transferring of claim 2, wherein the pattern-printed transfer film is manufactured by the steps of:

(i) mixing 40 to 60 wt % water, 20 to 30 wt % polyvinyl alcohol, 10 to 20 wt % pulp, 6 to 10 wt % starch, 2 to 4 wt % sugar, 3 to 7 wt % soap, 1 to 3 wt % glue, 3 to 7 wt % latex, 0.5 to 2 wt % silicon oil and 0.5 to 5 wt % water-soluble antistatic agent, dissolving at 80 to 100° C. paltruding the mixture in a thickness of 20 to 100 $\mu$m at a speed of 3 to 10 m/min using a roller, air-drying under a temperature of 60 to 150° C., and cooling under cold air to give a pulp layer;

(ii) laminating one side of the pulp layer thus obtained with a main layer which is prepared by mixing 40 to 60 wt % water, 22.5 to 33.5 wt % polyvinyl alcohol, 8 to 12 wt % starch, 2 to 4 wt % sugar, 3 to 7 wt % soap, 1 to 3 wt % glue, 3 to 7 wt % latex, 0.5 to 2 wt % silicon oil and 0.5 to 5 wt % water-soluble antistatic agent, dissolving at 80 to 100° C. paltruding the mixture in a thickness of 20 to 100 $\mu$m at a speed of 3 to 10 m/min using a roller, air-drying under a temperature of 60 to 150° C., and cooling under cold air; and, (iii) printing a desired pattern on the main film layer with an ink containing 20 to 30% (v/v) ceramic pigment, 40 to 60% (v/v) fluorinated resin dissolved in thinner, by the aid of a printing method of gravure, offset or silk screening.

* * * * *